United States Patent [19]

Prasch

[11] 4,023,548

[45] May 17, 1977

[54] LUBRICATING DEVICE FOR INTERNAL COMBUSTION ENGINES

[75] Inventor: Johann Prasch, Sindorf, Germany

[73] Assignee: Klockner-Humboldt-Deutz Aktiengesellschaft, Cologne, Germany

[22] Filed: Sept. 5, 1974

[21] Appl. No.: 503,491

[30] Foreign Application Priority Data

Sept. 6, 1973 Germany ..... 2344949

[52] U.S. Cl. ..... 123/196 CP; 184/6.2

[51] Int. Cl.[2] ..... F02M 1/00

[58] Field of Search ..... 184/6.2, 103 R; 123/196 R, 196 CP, 196 S

[56] References Cited

UNITED STATES PATENTS

| | | | |
|---|---|---|---|
| 1,000,188 | 8/1911 | Morse | 184/6.2 |
| 2,022,898 | 12/1935 | Niven | 184/6.2 |
| 2,440,815 | 5/1948 | Wharam et al. | 184/6.2 |
| 2,913,069 | 11/1959 | Kubis | 184/6.2 |
| 2,938,601 | 5/1960 | Brafford | 184/103 R |
| 3,590,953 | 7/1971 | Wellauer | 184/6.2 |
| 3,590,955 | 7/1971 | Rau | 184/6.2 |
| 3,805,920 | 4/1974 | Bensinger | 184/6.2 |

*Primary Examiner*—C. J. Husar
*Assistant Examiner*—Ira S. Lazarus
*Attorney, Agent, or Firm*—Walter Becker

[57] ABSTRACT

A lubricating device for internal combustion engines, especially for supplying oil to the points to be lubricated when the oil pan is in a very inclined position. The device comprises a pressure pump continuously withdrawing lubricating oil from a closed main chamber of an oil pan of the lubricating device and feeds the withdrawn oil to the points to be lubricated. The device also includes two open auxiliary oil chambers respectively located in the oil pan between the end walls of the oil pan and the major portion of the closed main chamber. The arrangement is such that oil withdrawn from the main chamber by the pressure pump also in inclined position of the oil pan automatically is replaced by oil from one of the auxiliary chambers.

11 Claims, 7 Drawing Figures

FIG.1
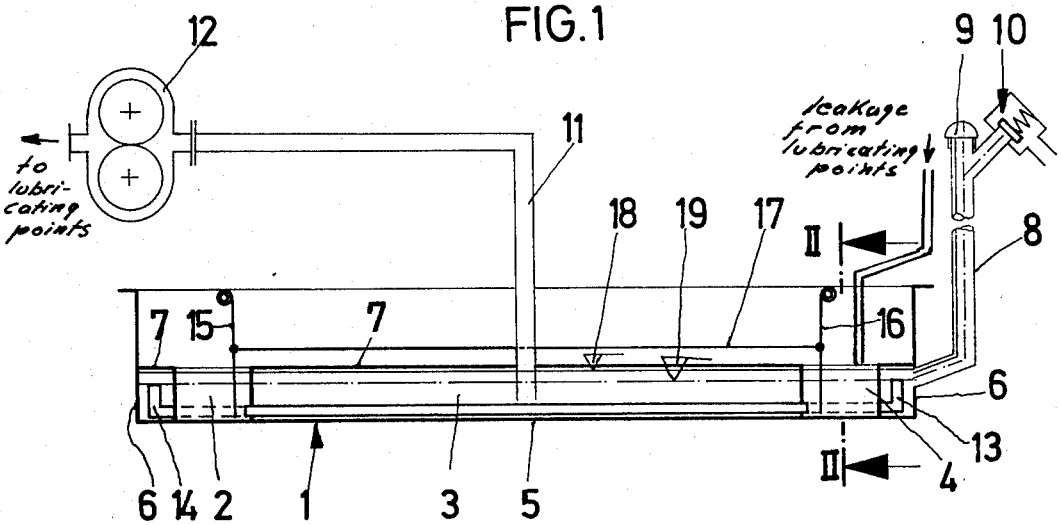
FIG.2
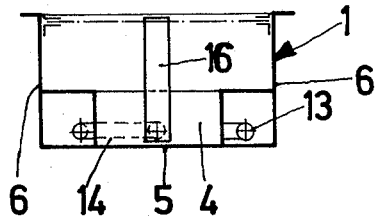
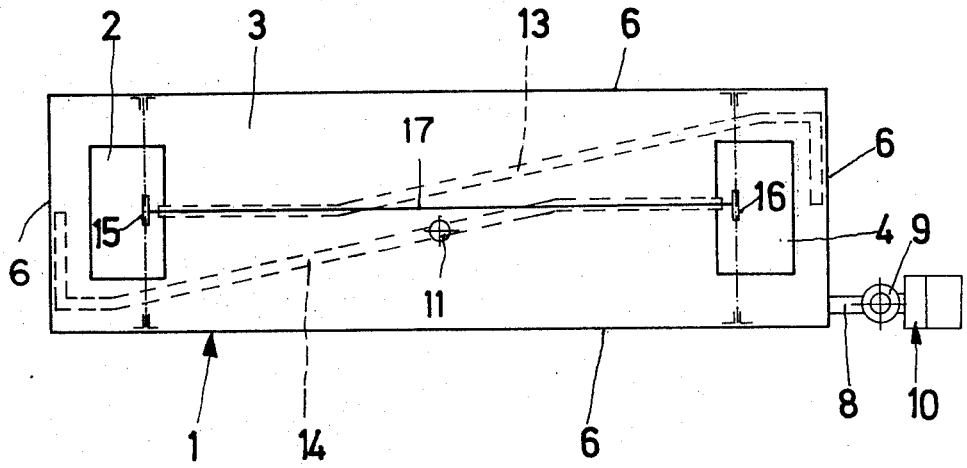
FIG.3

FIG.5
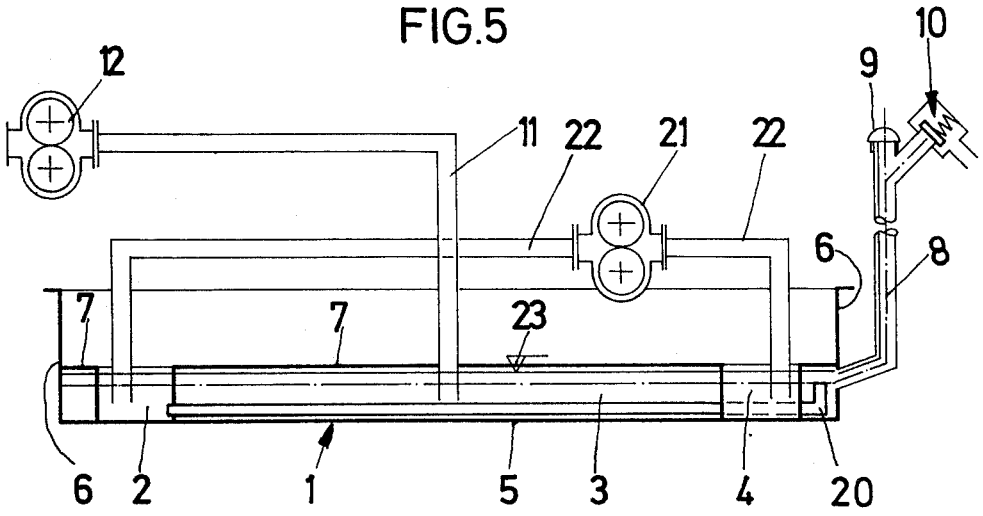
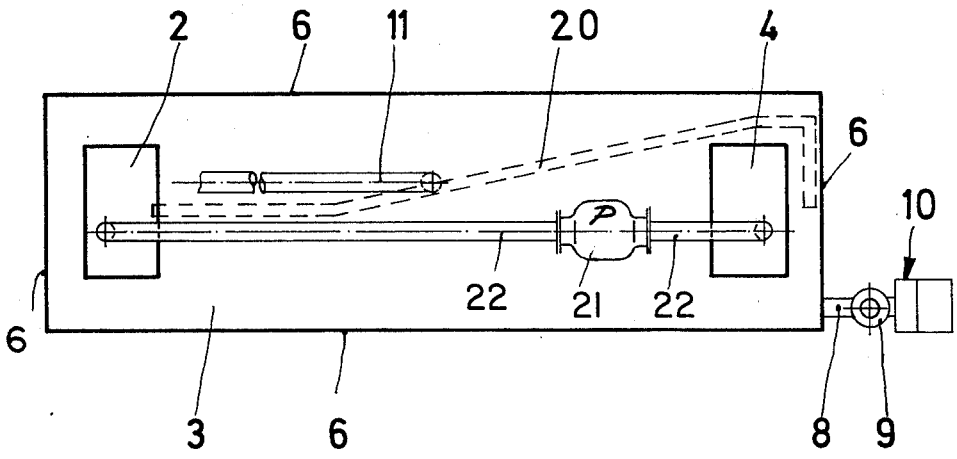
FIG.6

LUBRICATING DEVICE FOR INTERNAL COMBUSTION ENGINES

The present invention relates to a lubricating device for internal combustion engines for securing a safe oil supply when the engine is in a greatly inclined position, and more specifically concerns a lubricating device which is provided with an oil sump or oil pan having three oil chambers which in the longitudinal direction of the internal combustion engine are arranged one behind the other while the intermediate oil chamber is through a conduit connected to at least one outer oil chamber, said lubricating device additionally being provided with a pressure pump for supplying the lubricating points of the internal combustion engine with oil under pressure.

According to German Auslegeschrift No. 1, 192, 455, it is known with a lubricating device of the above mentioned type to connect the intermediate oil chamber by a first conduit with one of the two outer oil chambers and through a second conduit with the other one of said two outer oil chambers. The pressure pump for supplying the lubricating points of the engine draws oil under pressure from one outer oil chamber which is continuously supplied with oil by a delivery pump which latter withdraws the oil from the other outer oil chamber. Furthermore, the intermediate oil chamber and one of the two outer oil chambers is covered by a cover plate which covers at least half of the oil chambers. In order to assure the oil supply when the engine occupies a rather inclined position, the above-mentioned lubricating device comprises a considerable number of structural elements and therefore is rather expensive. In addition thereto, a connecting line is arranged between the intermediate and an outer oil chamber at half the height so that the partitions and the conduits cannot be produced from sheet metal parts inasmuch as in such instance the strength would be insufficient.

It is, therefore an object of the present invention to provide a lubricating device of the above mentioned general type which will avoid the above outlined drawbacks and will be considerably simpler and less expensive than heretofore known devices of the type involved.

These and other objects and advantages of the invention will appear more clearly from the following specification in connection with the accompanying drawings, in which:

FIG. 1 represents a diagrammatic section along an internal combustion engine through the oil pan of a lubricating device according to the invention which lubricating device comprises two conduits with flap valves.

FIG. 2 represents a section through the oil sump or oil pan, said section being taken along the line II—II of FIG. 1.

FIG. 3 is a top view of the oil sump according to FIG. 1, the pressure pump being omitted.

FIG. 5 represents a section along the internal combustion engine through the oil sump, in which an additional delivery pump is provided.

FIG. 6 is a top view of an oil sump according to FIG. 5 in which the pressure pump has been omitted but the delivery pump is shown.

Figure 4:
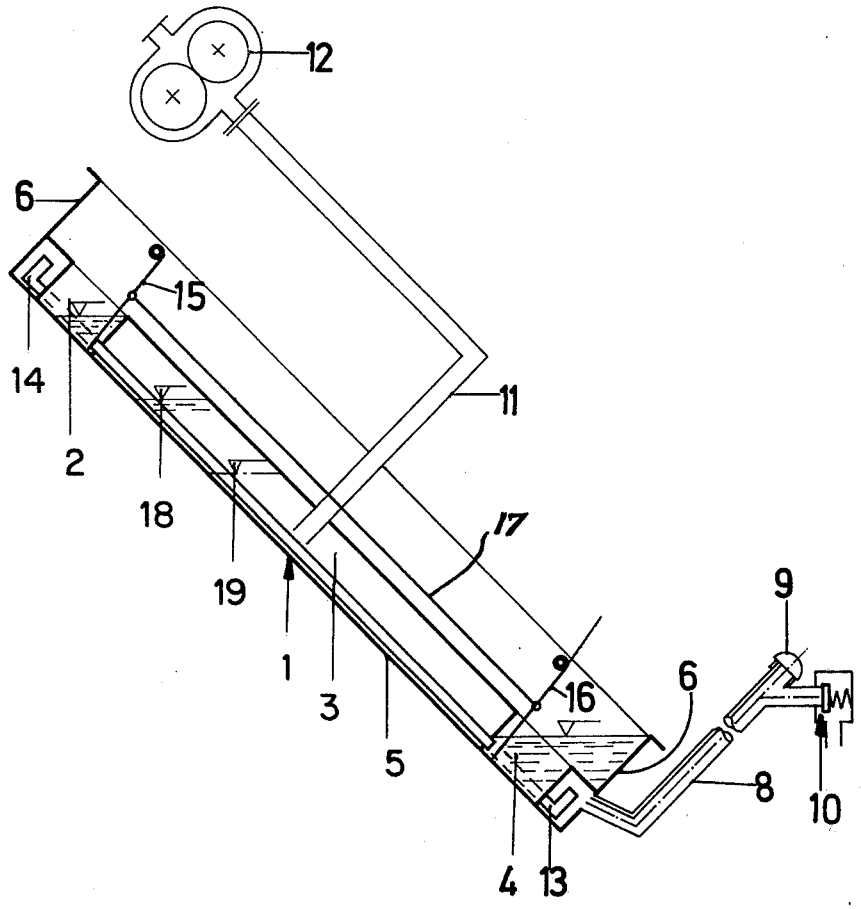
FIG. 4 illustrates an oil sump according to FIG. 1 shown in an inclined position.

The lubricating device according to the present invention with an oil sump having three oil chambers which in the longitudinal direction of the internal combustion engine are arranged one behind the other is characterized primarily in that the intermediate oil chamber is designed as a closed container and through a conduit communicates with the suction side of the pressure pump while conduits to the outer oil chambers are each controlled by a valve and are arranged between said outer oil chambers and that end of the closed container which faces away from the respective outer oil chamber. This arrangement according to the invention brings about that the pressure pump which is necessary anyhow will suffice for supplying the lubricating points of the internal combustion engine with oil under pressure so that no further delivery pump is necessary. The oil which from the bearing areas of the internal combustion engine flows back and is collected in the outer oil chambers and from there passes through the conduits into the intermediate closed container from where the required oil is drawn in by the pressure pump. If the oil pan occupies an inclined position, one of the valves closes the conduit leading to the then higher outer oil chamber, and the under-pressure which will then be generated in the intermediate closed container by the withdrawal of oil will draw oil from the lower outer oil chamber through a conduit into the closed cntainer so that on one hand not much oil remains in the lower oil chamber while the intermediate oil chamber is always sufficiently filled. This applies to both inclined positions in the same manner in view of the symmetric arrangement of the oil sump or oil pan.

With a lubricating device of the above mentioned type in which a delivery pump feeds oil from one outer oil chamber into the other, and in which said other oil chamber communicates through a conduit with the intermediate oil chamber, the problem underlying the present invention is solved by the fact that the intermediate oil chamber is designed as a closed container and through the conduit communicates with the suction side of the pressure pump. In contra-distinction to the above mentioned solution to the problem underlying the invention, the delivery pump will now deliver oil from one outer oil chamber into the other outer oil chamber while the oil can flow through the conduit into the intermediate container or chamber so that intermediate container or chamber will always remain sufficiently filled with oil, and the pressure pump can withdraw oil therefrom. If now the oil pan occupies an inclined position in which the outer oil chamber into which the delivery pump pumps oil, occupies the lower position, it will be appreciated that in conformity with the above remarks, due to the lower pressure in the intermediate closed container, oil can flow through the conduit into the intermediate container. When the oil pan occupies the opposite inclined position, the delivery pump brings about that the other outer oil chamber now occupying the higher position is always sufficiently filled with oil so that the oil can from here flow back through the conduit into the intermediate container. In this instance no underpressure is necessary for delivery the oil to the intermediate oil chamber.

According to a further development of the invention, it is suggested that the closed container comprises a cover plate which extends at least approximately parallel to the bottom of the oil pan. The outer oil chambers are inserted into said cover plate in spaced relationship to the walls of the oil pan. This design according to the invention makes it possible in a simple manner to displace the outer oil chambers toward each other toward the center so that the oil which flows back from the lubricating points can better collect. Furthermore, in view of this design it is possible to press the cover plate and the outer oil chambers of sheet metal parts which fact brings about a considerable reduction in cost. Furthermore, it is suggested that the outer oil chambers extend up to the bottom of the oil pan. In order to assure that the pressure pump will be able in the outer inclined position of the oil pan as well as in transverse positions always to draw in sufficient oil, it is advantageous if the suction line of the pressure pump leads into the closed container and more specifically at the geometric center of the bottom of the oil pan.

According to a further development of the invention it is suggested that the closed container be provided with a connection for filling oil thereinto. This connection is provided with a check valve for preventing the entry of air. This check valve on one hand is provided for the purpose to permit the underpressure in the closed container, and on the other hand when the oil pan returns to its horizontal position to equalize pressure differences and thereby differences in the oil level of the oil chambers. Consequently, the resistance of the check valve should be kept as low as technically possible. A favorable design for the valves of the conduits will be realized by designing the valve as gravity controlled unilaterally journaled flaps which arranged at the mouth of the conduits in the outer oil chambers. The flaps should be interconnected in such a way that only one flap can be closed at a time. The flaps need not particularly tightly close the mouth of the conduits because whenever one valve is closed, always a certain oil quantity will be available within this region which will increase the degree of closing of the valve. It is furthermore suggested that the conduits between the oil chambers are symmetrically designed and arranged and that the mouths of the conduits are connected in the outer oil chambers at about the level of the bottom thereof.

In view of the symmetrical design of the conduits, the same can be produced in a simpler and less expensive manner. The mouths in the outer oil chambers should be located rather deep so that also in greater inclined positions a safe post-flowing of the oil will be possible. Furthermore, it is suggested that the conduit or conduits in the closed container have their outlet or mouth between the outer oil chamber or chambers and the respective oil pan wall at the height of the minimum oil level.

Finally, it is also important with the lubricating device in which one delivery pump delivers oil from an outer oil chamber to the other oil chamber, that the mouth of the conduit between the intermediate and the other outer oil chamber is connected to the bottom thereof at the level of the bottom.

Referring now to the drawings in detail, the arrangement shown therein comprises an oil sump or oil pan 1, which has three oil chambers 2, 3 and 4. The intermediate oil chamber 3 is designed as a closed container and is confined by an oil pan bottom 5, oil pan walls 6 and a cover plate 7. The outer oil chambers 2 and 4 are inserted into the cover plate 7 and extend up to the oil pan bottom 5. The outer oil chambers 2 and 4 are laterally spaced with regard to the oil pan walls 6. Attached to the intermediate container 3 is a connection 8 for filling in oil, which connection has a closure or stopper 9 and a check valve 10. The check valve 10 is so arranged that for instance air can escape from the intermediate container, whereas an underpressure remains maintained in the intermediate container 3, approximately in the geometric center thereof, extends a pressure pump suction line 11, while the area of the cover plate 7 through which the line 11 extends is sealed. The conduit 11 extends on one hand closely to the oil pan bottom and on the other hand is connected to a pressure pump 12. The pressure pump 12 is driven by an internal combustion engine not shown in the drawing and supplies in customary manner the lubricating points with oil.

As will be further more evident from FIGS. 1 to 4, a conduit 13 is arranged in the intermediate container 3. This conduit 13 leads on one hand into the central area of the oil chamber 2, approximately at the height of the bottom, and on the other hand extends into the chamber between the outer oil chamber 4 and the oil pan wall 6. A corresponding conduit 14 symmetrically arranged with regard to the conduit 13 is provided between the outer oil chamber 4 and the chamber between the outer oil chamber 2 and the oil pan wall 6. The conduits 13 and 14 are in the oil chambers 2 and 4 operatively connected with one flap 15 and 16 each, said flaps being pivotally mounted at the upper edge of the oil pan 1.

The flaps 15 and 16 are connected by a rod 17. The length of the rod 17 is so selected that as will be evident from FIG. 1, both flaps are open when the oil pan occupies a horizontal position, whereas, in conformity with FIG. 4, one flap closes the mouth of one conduit while the other flap is in open position when the oil pan occupies an inclined position. In the oil pan 1 there is present a quantity of oil which in conformity with the arrows 18 and 19 may have a minimum or maximum level of filling. The ends of the conduits 13 and 14 are so arranged in the chambers between the outer oil chambers and the oil pan wall that they are flush with the minimum oil level.

Figure 7:
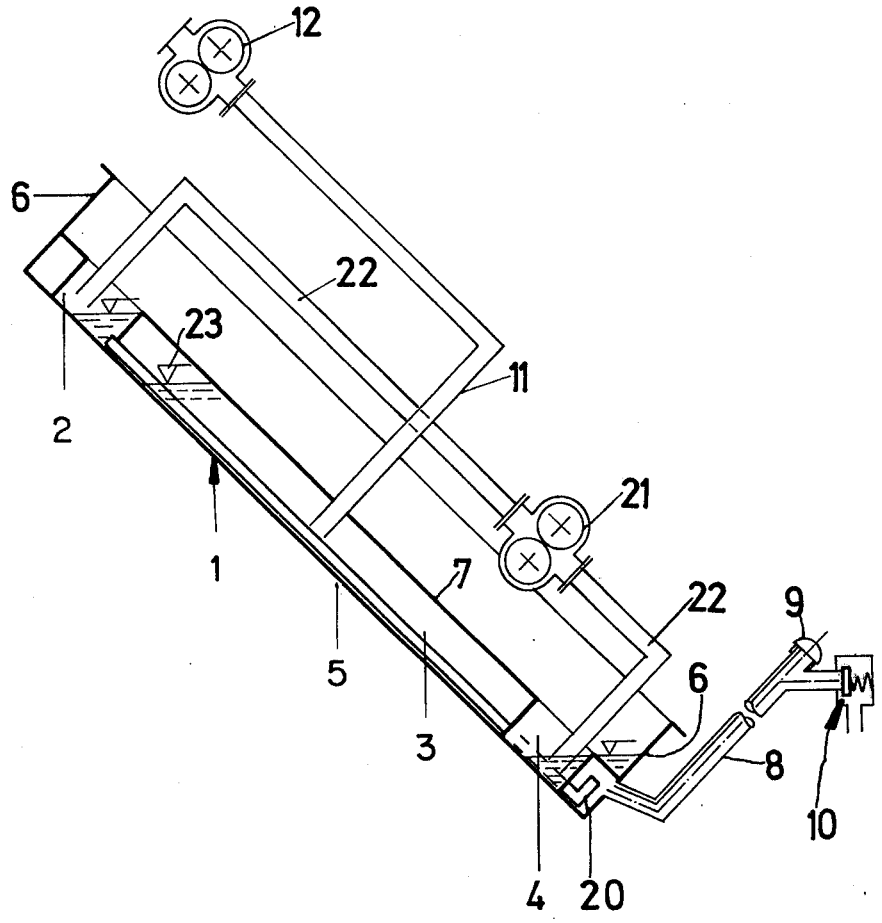
FIG. 7 is a section through an oil sump according to FIG. 5 shown in inclined position.

According to FIGS. 5, 6 and 7, in conformity with the conduit 13 of FIGS. 1–4, a conduit 20 is arranged between the outer oil chamber 4 and the oil pan wall 6. The conduit 20 leads into the closed container 3 according to conduit 13 and is connected in the oil chamber 2 likewise at the height of the bottom. In contrast to the flaps 15 and 16, the design according to FIGS. 5–7 comprises a delivery pump 21, which is arranged in a conduit 22 leading from the outer oil chamber 4 to the outer oil chamber 2. The conduit 22 is introduced into the outer oil chambers to such an extent that it can supply oil even in inclined position of the oil pan. The delivery pump 21 is in customary manner driven by the internal combustion engine and runs continuously. The pressure pump 2 and the delivery pump 21 are designed as double pump. In conformity with the arrows 18 and 19 in FIGS. 1–4, the arrow 23 marks the oil level.

The embodiment according to FIGS. 1–4 operates in the following manner. The pressure pump 12 withdraws through the suction line 11 oil from the closed container 3 and delivers this oil to the lubricating points of the internal combustion engine. If the relative level drops in the closed container 3, a slight underpressure is generated which through conduits 13 and 14 draws oil from the oil chambers 2 and 4. In the outer oil chambers 2 and 4, the oil flowing back from the lubricating points of the internal combustion engine is collected so that in this way the oil pan occupies its inclined position illustrated in FIG. 4, one flap, in the drawing flap 15, is placed upon the mouth of the conduit 13 and closes the same. It is not necessary that flap 15 lies on the mouth in a completely sealing manner, because, as will be evident from FIG. 4, a certain quantity of oil remains in the outer oil chamber 2 so that the seal between flap and conduit is increased. In the outer oil chamber 4 such quantity of oil has collected that the mouth of the conduit 14 is below the oil level while in view of the rod 17 it will be assured that the flap 16 does not close the mouth of conduit 14. In the closed container 3 as indicated by arrow 19 showing the minimum oil level, sufficient oil is present so that the pressure pump 12 can deliver oil in customary manner. The underpressure in the closed container now draws exclusively through conduit 14 oil from the outer oil chamber 4 because also the total oil flowing back from the lubricating points collects in the oil chamber 4. Also when the oil pan occupies its inclined position, the required underpressure in the closed container is relatively low as will be clear from the difference in height between the mouth of the conduit 14 in the closed container and the arrow 19 so that no cavitation problems will occur.

In the opposite inclined position shown in FIG. 4, the lubricating device operates in the same manner while, however, in such instance the flap 16 closes the conduit 14 and the oil flows through conduit 13 from the outer oil chamber 2 into the intermediate containers. As will be evident from the remarks set forth in connection with FIGS. 1 to 4, the present embodiment represents a simple design of a lubricating device which in spite of few elements assures a safe function. The only requirement consists in that the intermediate oil chamber must be closed off to such an extent that an underpressure can build up which, however, is only of a low magnitude and therefore can easily be sealed. The check valve has the purpose to compensate the slight overpressure which might possibly occur when changing from the inclined position to the horizontal position. Said slight overpuressure may be caused by the flowing of oil from one of the outer oil chambers. The check valve is furthermore intended to permit the escape of air which might have entered the closed container with the oil.

According to the embodiment of FIGS. 5–7, the delivery pump 21 continuously delivers oil from the outer oil chamber 4 to the outer oil chamber 2 so that from the latter through conduit 20 always so much oil can flow into the closed container 3 as the pressure pump 12 withdraws therefrom. A difference in the quantity of oil between the minimum and the maximum oil level is therefore normally visible in the outer oil chamber 4 because when the outer oil chamber 4 is filled, the oil can flow back over the cover plate 7. In the inclined position shown in FIG. 7, the delivery pump 21 will see to it that the outer oil chamber will always contain so much oil that oil will flow through conduit 20 and no air will be drawn in. Only in this inclined position will the delivery pump 21 be necessary at all because in the inclined position in which the outer oil chamber 4 is at a higher level than the outer oil chamber 2, the outer oil chamber 2 is always filled with oil because the oil flows by itself from the outer oil chamber 4 over the cover plate 7. In both instances, therefore, the oil is from the outer oil chambers through the conduit 20 conveyed to the closed container 3. This is effected in the inclined position of FIG. 7 by an automatic flowing of the oil from the outer oil chamber 2.

In the opposite inclined position, according to the embodiment of FIGS. 1–4, the oil is in view of the underpressure in closed container 3 drawn through conduit 20.

It is, of course, to be understood, that the present invention is, by no means, limited to the specific showing in the drawings, but also comprises any modifications within the scope of the appended claims.

What I claim is:

1. A lubricating device for an internal combustion engine for securing the oil supply to the points to be lubricated, also in greatly inclined positions of said device, which includes in combination: a longitudinal oil pan comprising a closed main chamber, a first open auxiliary chamber arranged near one end of said oil pan, and a second open auxiliary chamber arranged near the other end of said oil pan, the major portion of said main chamber being located between said first and second auxiliary chambers, said main chamber also including a space between each of said auxiliary chambers and the respective adjacent end wall of said oil pan; single pressure pump means having a pressure side for connection with an oil conveying line leading to points to be lubricated, said pressure pump also having a suction side, first conduit means establishing communication only between said suction side and the interior of said closed main chamber; second conduit means leading from the space between one of said open auxiliary chambers and the adjacent end wall of said oil pan to the other one of said open auxiliary chambers, and third conduit means communicating on one hand with one of said auxiliary chambers and on the other hand being adapted to communicate with said main chamber.

2. A device in combination according to claim 1, in with said third conduit means leads from the space between the other one of said open auxiliary chambers and the adjacent end wall of said oil pan to said one auxiliary chamber.

3. A device in combination according to claim 1, which includes a cover plate forming part of and covering said main chamber while extending substantially parallel to the bottom of said oil pan and having said first and second open auxiliary chambers inserted thereinto.

4. A device in combination according to claim 3, in which said first and second open auxiliary chambers extend down to the bottom of said oil pan.

5. A device in combination according to claim 1, in which said first conduit means leads into said main chamber aproximately at the geometric center of the bottom of said oil pan.

6. A device in combination according to claim 1, which includes an oil inlet connection provided on and leading into said closed main chamber, and check valve means on said inlet connection for preventing air from entering said main chamber.

7. A device in combination according to claim 2, which includes valves in the form of unilaterally journaled gravity controlled flaps respectively ssociated with those ends of said second and third conduit means which lead into said first and second auxiliary chambers.

8. A device in combination according to claim 7, which includes means so interconnecting said flaps as to permit only one of said flaps to close at a time.

9. A device in combination according to claim 1, in which said second and third conduit means lead into said auxiliary chambers approximately at the bottom of said oil pan and are symmetrically arranged between said first and second auxiliary chambers.

10. A device in combination according to claim 1, in which at least one of said second and third conduit means between at least one of said first and second auxiliary chambers and the respective adjacent end wall of said oil pan lead into said closed main chamber at the desired minimum oil level in said closed main chamber.

11. A lubricating device for internal combustion engines, which includes in combination a longitudinal oil pan comprising a closed main chamber taking up the major portion of said oil pan and also comprising a first and a second open auxiliary chamber respectively arranged adjacent but in spaced relationship to the end walls of said oil pan while the major portion of said main chamber is located between said auxiliary chambers; a pressure pump having a suction side and a pressure side for supplying oil under pressure to points to be lubricated; a conduit leading only from said closed main chamber to said pressure pump; and means controlling the supply of oil from said auxiliary chambers to said main chamber.

* * * * *